United States Patent [19]

Dajnko et al.

[11] Patent Number: 4,838,002

[45] Date of Patent: Jun. 13, 1989

[54] CLIP FASTENER SECURABLE TO CEILING T-BAR TO RETAIN WALL PARTITION IN POSITION

[76] Inventors: Milan A. Dajnko, 32 Neeland Rd.; Marjan J. Dajnko, 96 Kyla Crescent; Daniel M. Dajnko, 165 Highglen Avenue, all of Markham, Ontario L3S 1W9, Canada

[21] Appl. No.: 192,065

[22] Filed: Jun. 27, 1988

[51] Int. Cl.[4] ..... E04B 1/40

[52] U.S. Cl. ..... 52/489; 52/238.1; 52/715

[58] Field of Search ..... 52/712, 484, 238.1, 52/489, 715

[56] References Cited

U.S. PATENT DOCUMENTS

| | | | |
|---|---|---|---|
| 3,463,432 | 8/1969 | Ptak | 52/489 X |
| 3,557,506 | 1/1971 | Pechenik | 52/484 X |
| 3,797,192 | 3/1974 | DeJonge | 52/484 X |
| 4,191,352 | 3/1980 | Schuplin | 52/484 X |
| 4,680,902 | 6/1987 | Stefnik et al. | 52/126.4 |

FOREIGN PATENT DOCUMENTS

| | | | |
|---|---|---|---|
| 245774 | 3/1966 | Austria | 52/489 |
| 78070 | 5/1962 | France | 52/484 |
| 955904 | 7/1964 | United Kingdom | 52/489 |

*Primary Examiner*—David A. Scherbel
*Assistant Examiner*—Lan Mai
*Attorney, Agent, or Firm*—Robert F. Delbridge; Arne I. Fors

[57] ABSTRACT

A clip fastener for securing a partition wall to a ceiling T-Bar framework, has a clip portion of resilient material having a main body with opposed side edges. One side edge has a pair of longitudinally spaced shorter tabs overlying the main body, each shorter tab being a folded-over extension of said one side edge, and the opposite edge has a pair of longitudinally-spaced longer tabs overlying the main body, each longer tab being a folded-over extension of the opposite side edge. The width of the main clip body is greater than the width of opposed flanges of a T-Bar by an amount slightly greater than the length of the shorter tab in the direction of the longer tabs to enable the clip portion to be assembled with opposed flanges of a T-Bar by causing one flange to pass between the longer tabs and the main clip body, and then causing the opposite flange to pass between the shorter tab and the main clip body whereby both the shorter tabs and the longer tabs are in engagement with upper surfaces of the flanges. The main clip body has a depressed portion with a threaded aperture to enable a bolt to be assembled therewith by screwing the bolt shank downwardly through the aperture to position the head in engagement with the depressed portion of the main clip body below the level of the tabs. The bolt acts as an attachment for a track for a partition wall.

3 Claims, 3 Drawing Sheets

CLIP FASTENER SECURABLE TO CEILING T-BAR TO RETAIN WALL PARTITION IN POSITION

This invention relates to clip fasteners for securing interior partition walls to T-Bar ceiling frameworks.

It has become conventional to secure interior partition walls, for example in an office building, to a conventional T-Bar ceiling framework by means of clip fasteners which comprise a clip portion which clips over opposed flanges of a ceiling T-Bar (which is of course actually an inverted "T") and a bolt carried by the clip portion which projects downwardly therefrom to enable a track for a partition wall to be secured thereto. One example of such a clip fastener is shown in U.S. Pat. No. 4,680,902 (Stefnik et al), see FIG. 4. However, known clip fasteners of this kind have various disadvantages, a primary disadvantage being the difficulty of securing such a clip fastener at a position where T-Bars intersect because such clip fasteners have to be installed by a rotary motion.

It is therefore an object of the present invention to provide an improved clip fastener which does not have to be installed with a rotary motion and which can be readily installed at T-Bar intersections.

According to the invention, a clip fastener comprises a clip portion of resilient material having a main body with opposed side edges, one side edge having a pair of longitudinally spaced shorter tabs overlying the main body, each shorter tab being a folded-over extension of said one side edge, and the opposite side edge having a pair of longer tabs overlying the main body, each longer tab being a folded-over extension of the opposite side edge. The width of the main clip body is greater than the width of opposed flanges of the T-Bar by an amount slightly greater than the length of the shorter tabs in the direction of the longer tabs to enable the clip portion to be assembled with the opposed flanges of the T-Bar by causing one flange to pass between the longer tabs and the main clip body and then causing the opposite flange to pass between the shorter tabs and the main clip body, whereby both the shorter tabs and the longer tabs and then in engagement with upper surfaces of the flanges.

The main clip body has a depressed portion with a threaded aperture to enable a bolt comprising a head and a threaded shank to be assembled therewith by screwing the bolt shank downwardly through the aperture to position the bolt head in engagement with the depressed portion of the main clip body and below the level of the tabs. The bolt provides means for retaining partition wall supporting means.

A clip fastener in accordance with the invention can be readily secured to ceiling T-Bars, including at intersections thereof, and can also be readily removed therefrom when desired.

Figure 1:
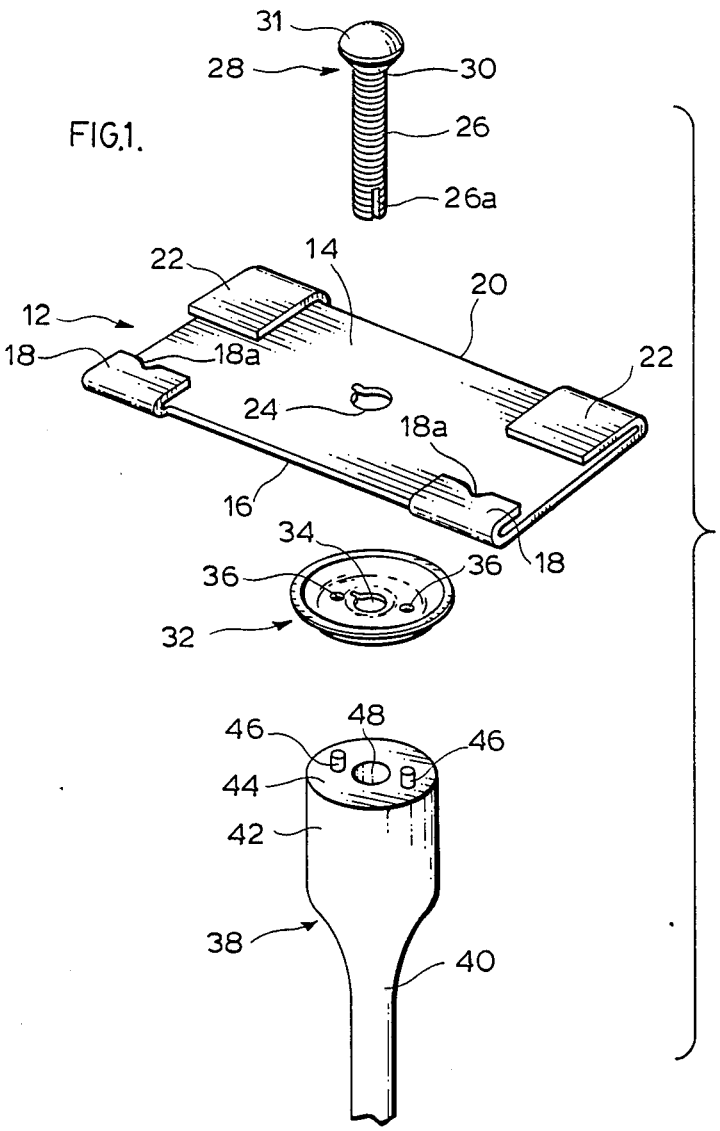
Figure 2:
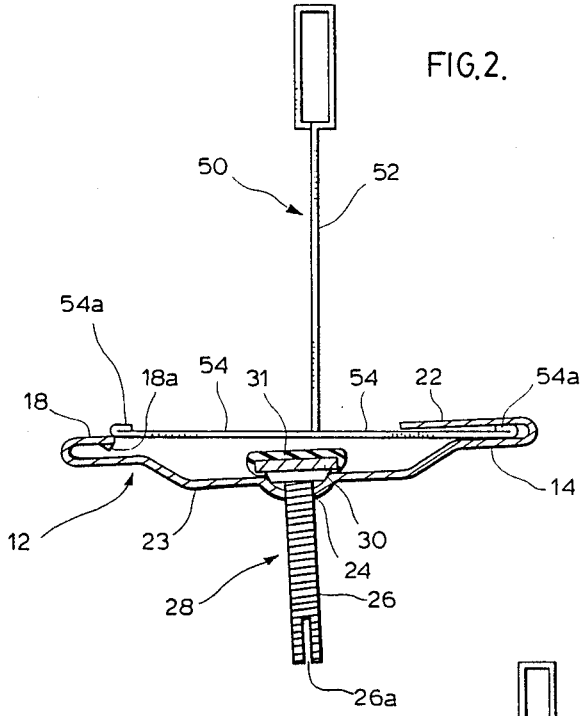
Figure 3:
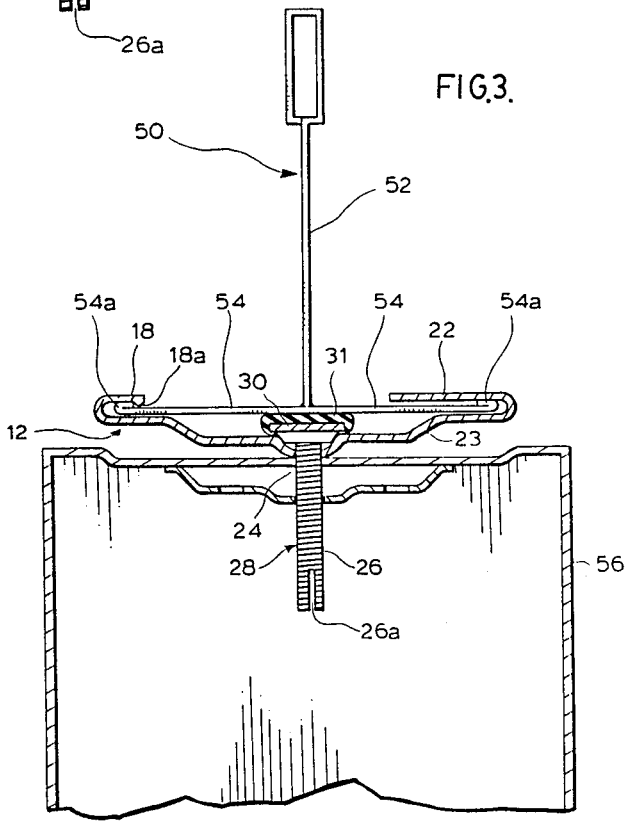
Figure 4:
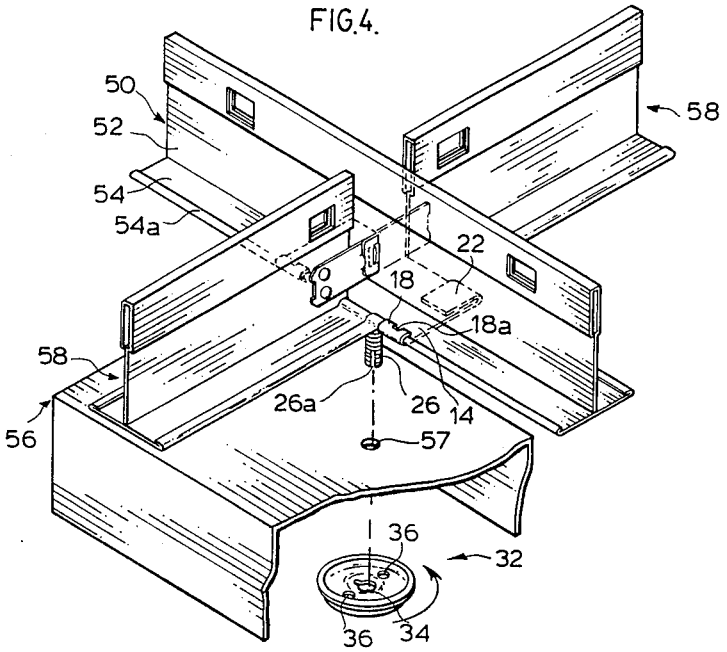
Figure 5:
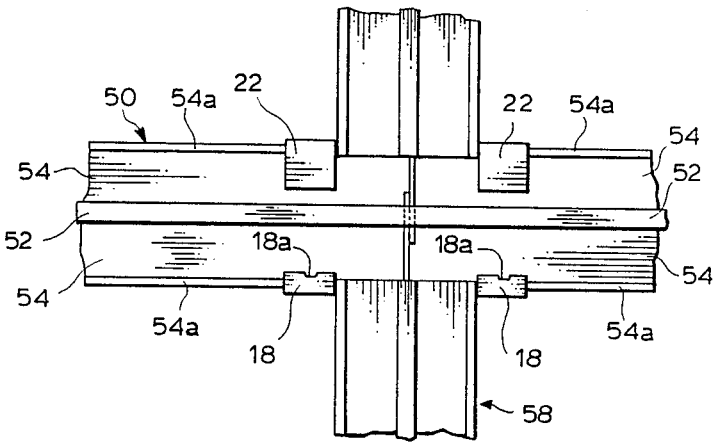

An embodiment of the invention will now be described, by way of example, with reference to the accompanying drawings, of which:

FIG. 1 is an exploded pespective view of a clip fastener, also showing a tool for rotating the washer-nut on the bolt, FIG. 2 is a sectional view showing the clip fastener partially installed on a T-Bar, FIG. 3 is a similar view showing the clip fastener fully installed and with a partition secured thereto, FIG. 4 is a perspective view showing the clip fastener secured to a T-Bar intersection, and FIG. 5 is a plan view of the assembly FIG. 4.

Referring to the drawing, a clip fastener has a resilient sheet metal clip portion 12 with a generally flat rectangular main body 14. One side edge 16 of the main body 14 has two longitudinally spaced short tabs 18, one at each end, which are folded-over extensions of the side edge 16 so that the short tabs 18 overlie the main body 14. The opposite side 20 of the main body 14 has two longitudinally spaced longer tabs 22, one at each end, which are folded-over extensions of the side edge 20 so that the longer tabs 22 also overlie the main body 16. Each shorter tab 18 extends towards and is spaced from a longer tab 22, the tabs 18, 22 being spaced above the main clip body 14. The free ends of the short tabs 18 have downwardly projecting deformations **18*a*** which function to retain the clip fastener in assembly with a T-Bar as will be described later.

The central portion 23 of the main clip body 14 is depressed, as shown more clearly in FIGS. 2 and 3, and has a central aperture 24 whose edge is screw-threaded so as to receive the threaded shank 26 of a bolt 28 with a head 30. When the bolt 28 is fully screwed in to the aperture 24, the head 30 sits in the depressed central portion 23 so that the head 30 is below the tabs 18, 22. The lower end of shank 26 has a slot **26*a* for a purpose which will be described later. The bolt head is covered by a rubber cap 31**.

A circular combination washer-nut 32 is also made of resilient sheet metal and has a central threaded aperture 34 so that it can be screwed on to bolt shank 26. The nut 32 also has a pair of small holes 36 on diametrically opposite sides of the central aperture 34 engageable by a manually-operable nut-tightening tool 38. Tool 38 has a manually-gripable shaft 40 which may carry a handle (not shown) at its lower end. The upper end of the shaft 40 widens into a head 42 with a flat upper surface 44. The upper surface 44 having two peg-like projections 46 engageable in the holes 36 in the nut 32 and a central bore 48 to loosely receive the bolt shank 26.

The clip fastener is intended for use with a conventional T-Bar ceiling framework, one T-Bar 50 being shown in FIGS. 2 and 3. The T-Bar 50 has a vertical portion 52 and a horizontal portion at the lower end thereof comprising of two oppositely directed flanges 54. The flanges 54 have bent-over edges which provide longitudinally-extending lips 54a on the upper surfaces of the flanges 54.

The width of the main clip body 14 is slightly greater than the combined width of the T-Bar flange 54 plus the length of the short tabs 18 in the direction of the longer tabs 22. In use, the bolt 28 is assembled with the clip portion 12 as shown in FIG. 2, with the bolt shank 26 fully screwed into the central aperture 24 of the clip body 14 so that the bolt head 30 lies within the central depressed portion 23. The clip portion 12 is then mounted on the flanges 54 of the T-Bar 50 by first causing one flange 54 to enter between the main clip body 14 and the longer tabs 22, so that the clip fastener 12 is then in the position shown in FIG. 2.

The other T-Bar flange 54 is then caused to enter between the main clip body 14 and the shorter tabs 18 until the tab defamations **18*a* snap over the ends of the flange lips 54*a*. The length of the shorter tabs 18 is slightly greater than the width of the flange lips 54*a*. This positions the clip portion 12 as shown in FIG. 3. By inserting a screwdriver into a shank slot 26*a*, the bolt 28 can be screwed upwardly to cause the bolt head 30 to engage the underside of the flanges 54 and thereby firmly anchor the clip fastener in place. The rubber cap 31 on the bolt head 30** prevents scratching and slipping during installation.

A conventional metal track 56 (see FIG. 3) for supporting a partition wall (not shown) can then be secured to the bolt shank 26 by causing the bolt shank 26 to pass through a central aperture 57 in the track 56 (see FIG. 4). The track 56 is then retained in place by positioning washer-nut 32 on the end of the tool 38 (as indicated in FIG. 1) and screwing the nut 32 onto the shank 26 by means of the tool 38 until the track 56 is held firmly in engagement with the underside of the clip portion 12. A partition can then be installed in a conventional manner.

FIGS. 4 and 5 show a primary advantage of the clip fastener in accordance with the invention, namely the ease with which the clip fastener can be installed at an intersection of a main T-Bar 50 and a pair of cross T-Bars 58. Thus, the clip fastener can be easily fitted on to T-Bars, including at their intersections, and can also be easily removed when desired.

Other advantages of the invention will be readily apparent to a person skilled in the art, the scope of the invention being defined in the appended claims.

I claim:

1. A clip fastener for securing a partition wall to a ceiling T-Bar framework, comprising a clip portion of resilient material having a main body with opposed side edges, one side edge having a pair of longitudinally spaced shorter tabs overlying the main body, each shorter tab being a folded-over extension of said one side edge, and the opposite edge having a pair of longitudinally-spaced longer tabs overlying the main body, each longer tab being a folded-over extension of the opposite side edge, the width of the main clip body being greater than the width of opposed flanges of a T-bar by an amount slightly greater than the length of the shorter tab in the direction of the longer tabs to enable the clip portion to be assembled with opposed flanges of a T-Bar by causing one flange to pass between the longer tabs and the main clip body and then causing the opposite flange to pass between the shorter tab and the main clip body whereby both the shorter tabs and the longer tabs are in engagement with upper surfaces of the flanges, the main clip body having a depressed portion with a threaded aperture to enable a bolt comprising a head and a threaded shank to be assembled therewith by screwing the bolt shank downwardly through the aperture to position the head in engagement with the depressed portion of the main clip body below the level of the tabs, said bolt providing means for retaining partition walls supporting means.

2. A ceiling T-Bar and clip fastener assembly for securing a partition wall to the T-Bar, the clip fastener comprising a clip portion of a resilient material having a main body with opposed side edges, one side edge having a pair of longitudinally spaced shorter tabs overlying the main body, each shorter tab being a folded-over extension of said one side edge, and the opposite side edge being a pair of longitudinally spaced longer tabs overlying the main body, each longer tab being a folded-over extension of said opposite side edge, the width of the main clip being greater than the width of opposed flanges of the T-Bar by an amount slightly greater than the length of the shorter tabs in the direction of the longer tabs to enable the clip portion to be assembled with the opposed flanges by causing one flange to pass between the longer tabs and the main clip body and then causing the opposite flange to pass between the shorter tabs and the main clip body to position both the shorter tabs and the longer tabs in engagement with upper surfaces of the flanges, the main clip body having a depressed portion with a threaded aperture, and the clip fastener also including a bolt comprising a head and a shank, the shank extending downwardly through the aperture in the depressed portion of the main clip body and the head engaging a lower surface of a T-Bar to fixedly secure the clip fastener thereto, said bolt providing means for retaining partition wall supporting means.

3. "A ceiling T-Bar intersection and clip fastener assembly for securing a partition wall to the T-Bar intersection, said T-Bar intersection comprising a main T-Bar and a pair of cross T-Bars extending perpendicularly thereto on opposite sides thereof, the clip fastener comprising a clip portion of a resilient material having a main body with opposed side edges, one side edge having a pair of longitudinally spaced shorter tabs overlying the main body, and each shorter tab being a folded-over extension of said one side edge, and the opposite side edge being a pair of longitudinally spaced longer tabs overlying the main body, each longer tab being a folded-over extension of said opposite side edge, the width of the main clip being greater than the width of opposed flanges of the main T-bar by an amount slightly greater than the length of the shorter tabs in the direction of the longer tabs to enable the clip portion to have been assembled with the opposed flanges of the main T-Bar by causing one flange to pass between the longer tabs and the main clip body, with the longer tabs being located on opposite side of one cross T-Bar, and then causing the opposite flange of the main T-Bar to pass between the shorter tabs and the main clip body, with the shorter tabs being located on opposite sides of the other cross T-Bar, to position both the shorter tabs and the longer tabs in engagement with upper surfaces of the flanges of the main T-Bar, the main clip body having a depressed portion with a threaded aperture, and the clip fastener also including a bolt comprising a head and a shank, the shank extending downwardly through the aperture in the depressed portion of the main clip body and the head engaging a lower surface of the main T-Bar to fixedly secure the clip fastener thereto, said bolt providing means for retaining partition wall supporting means."

* * * * *